US006333107B1

(12) United States Patent
Ogawa et al.

(10) Patent No.: US 6,333,107 B1
(45) Date of Patent: Dec. 25, 2001

(54) FINE ELECTRICALLY CONDUCTIVE FIBER, AND RESIN COMPOSITION AND CONDUCTIVE YARN COMPRISING THE SAME

(75) Inventors: Hiroshi Ogawa; Jun Ogawa; Hiroyuki Monde, all of Tokushima (JP)

(73) Assignee: Otsuka Kagaku Kabushiki Kaisha, Osaka (JP)

( * ) Notice: Subject to any disclaimer, the term of this patent is extended or adjusted under 35 U.S.C. 154(b) by 0 days.

(21) Appl. No.: 09/622,542

(22) PCT Filed: Feb. 10, 1999

(86) PCT No.: PCT/JP99/00573

§ 371 Date: Aug. 18, 2000

§ 102(e) Date: Aug. 18, 2000

(87) PCT Pub. No.: WO99/43876

PCT Pub. Date: Sep. 2, 1999

(30) Foreign Application Priority Data

Feb. 25, 1998 (JP) ..... 10-064206

(51) Int. Cl.[7] ..... D01F 6/00
(52) U.S. Cl. ..... 428/372; 428/375; 428/394
(58) Field of Search ..... 428/372, 375, 428/394; 106/36; 501/95, 134; 423/598, 600

(56) References Cited

U.S. PATENT DOCUMENTS

| | | | | |
|---|---|---|---|---|
| 3,697,634 | * | 10/1972 | Staudhammer et al. | 264/109 |
| 4,590,234 | * | 5/1986 | Tasaka et al. | 524/413 |
| 4,999,244 | * | 3/1991 | Morimoto et al. | 428/372 |
| 5,383,963 | * | 1/1995 | Kobayashi et al. | 106/36 |
| 5,780,152 | * | 7/1998 | Ichiryu et al. | 428/394 |
| 5,942,205 | * | 8/1999 | Murata et al. | 428/615 |
| 6,004,039 | * | 12/1999 | Yabe et al. | 384/463 |
| 6,013,238 | * | 1/2000 | Murata et al. | 423/598 |
| 6,036,938 | * | 3/2000 | Konnai et al. | 423/592 |
| 6,114,079 | * | 9/2000 | Christian et al. | 430/201 |

FOREIGN PATENT DOCUMENTS

| | | |
|---|---|---|
| 63-270860 | 11/1988 | (JP) . |
| 5-287612 | 11/1993 | (JP) . |
| 9-241918 | 9/1997 | (JP) . |
| 10-226759 | 8/1998 | (JP) . |

* cited by examiner

*Primary Examiner*—N. Edwards
(74) *Attorney, Agent, or Firm*—Kubovcik & Kubovcik

(57) ABSTRACT

An electroconductive fiber comprising a fibrous core material whose surface is coated with an electroconductive substance, the fibrous core material having an average fiber length of 1 to 5 μm, an average fiber diameter of 0.01 to 0.5 μm and an aspect ratio of 3 or more, electroconductive resin composition containg the electroconductive fibers, and electroconductive thread prepared by spinning the electroconductive resin composition.

3 Claims, No Drawings

FINE ELECTRICALLY CONDUCTIVE FIBER, AND RESIN COMPOSITION AND CONDUCTIVE YARN COMPRISING THE SAME

This application is the National Stage Application of PCT/JP99/00573 filed Feb. 10, 1999.

TECHNICAL FIELD

With a recent spread of portable electronic gears, a proposal was made to line the pockets of a suit with a fabric capable of shielding against the electromagnetic waves generated by the electronic gears to mitigate the influence of electromagnetic waves on the human body. The electroconductive materials proposed for control of electricity, imparting electroconductivity or shielding against electromagnetic wave include, for example, surfactants, carbon-type or tin antimony-type electroconductive fillers, metallic fibers and metal-plated fibers.

BACKGROUND ART

However, when a surfactant is used, a sufficient electroconductivity is not imparted and its use is limited. When metallic fibers or metal-plated fibers are used, the electroconductivity is impaired by oxidation and the design is limited due to metallic luster.

On the other hand, carbon-type or tin antimony-type electroconductive fillers pose problems of having low whiteness degree and poor dispersibility and producing dust, so that they are singly usable only for limited purposes. Nevertheless, electroconductive fillers useful for coating potassium titanate fibers, titania fibers, silica or like inorganic fillers show a high resin-reinforcing ability, and the obtained electroconductive compositions have various excellent properties such as superior strength, high electroconductivity, proper surface properties and uniform electroconductivity. Consequently these fillers are now in wide use to render resins electroconductive. Further, it has been proposed to spin a resin composition containing a resin and such electroconductive fillers for the production of electroconductive threads (JP-A-63-196717). However, the proposed method poses a problem of entailing a difficulty in continuous spinning because the filter and nozzles are clogged with large-size fillers in the spinning operation, thereby increasing the back pressure of the nozzles.

An object of the present invention is to provide fine electroconductive fibers and an electroconductive thread prepared from the fibers which thread is excellent in strength and electroconductivity.

Another object of the present invention is to provide an electroconductive thread having a high whiteness degree.

A further object of the present invention is to provide an electroconductive resin composition suitably usable as a raw material for the electroconductive thread.

DISCLOSURE OF THE INVENTION

The present invention provides an electroconductive fiber comprising a fibrous core material whose surface is coated with an electroconductive substance, the fibrous core material having an average fiber length of 1 to 5 $\mu$m, an average fiber diameter of 0.01 to 0.5 $\mu$m and an aspect ratio of 3 or more.

According to the present invention, there is provided an electroconductive resin composition containing a resin and the electroconductive fibers.

According to the present invention, there is provided an electroconductive thread prepared by spinning the electroconductive resin composition.

The electroconductive fiber of the present invention comprises a fibrous core material having a surface coated with an electroconductive substance, the fibrous core material possessing an average fiber length of 1 to 5 $\mu$m, an average fiber diameter of 0.01 to 0.5 $\mu$m and an aspect ratio of 3 or more.

The core material used herein for the electroconductive fiber has an average fiber length of 1 to 5 $\mu$m, preferably 1 to 4 $\mu$m, an average fiber diameter of 0.01 to 0.5 $\mu$m, preferably 0.01 to 0.2 $\mu$m, and an aspect ratio of 3 or more. Since the core material may be broken to a shorter length in a processing procedure to be described later, it is possible to use a core material having a fiber length longer than said range in the initial stage but falling within said range in the final stage.

Preferred core materials include a titania compound represented by the formula $mK_2O.nTiO_{2-x}.yH_2O$ wherein m is 0 or 1, n is 1 or a number of 4 to 8, x is a number in the range of $0 \leqq x < 2$, y is a number of 0 to 10, provided that when m is 0, n is 1, whereas when m is 1, n is a number of 4 to 8.

Preferred examples of the core material to be used herein are potassium, tetratitanate fibers, potassium, hexatitanate fibers, potassium, octatitanate fibers and monoclinic titania fibers.

Of the core materials, those consisting essentially of a compound represented by $K_2O.4TiO_2.yH_2O$ wherein y is as defined above can be prepared by baking at 870 to 970° C. at least one species selected from titanium, compounds capable of producing titanium, dioxide by, e.g., heating, potassium compounds capable of producing potassium oxide by heating, potassium halide, metallic oxide and metal-containing compounds capable of producing metallic oxide by heating (the metal being e.g., at least one species selected from Mg, Al, Si, Fe, Ni and Mn). When the fibrous core material is treated with an acid or otherwise for removal of potassium, and is baked, the procedure gives a core material having a specific shape and comprising a potassium hexatitanate of the formula $K_2O.6TiO_2.yH_2O$, potassium octatitanate of the formula $K_2O.8TiO_2.yH_2O$, monoclinic titania of the formula $TiO_2.yH_2O$ or the like.

Of the compounds of the formula $mK_2O.nTiO_{2-x}.yH_2O$, those wherein x is <2 are obtained by baking in a non-oxidizing or reducing atmosphere or by heat treatment in a non-oxidizing or reducing atmosphere in a step of forming an electroconductive coating as described later. These core materials are electroconductive themselves and thus preferable. The electroconductive fibers of the present invention can be prepared by coating the surface of core material with carbon, tin oxide or like electroconductive substances. When the desired fibers are required to have whiteness, a core material coated with tin oxide or the like is preferable. When the color of desired product is not important, a core material coated with carbon which is available at relatively low costs is preferable. The surface of the core material can be coated with carbon by the steps of placing the core material into a rotary kiln or a rolling firing furnace or the like in which the atmosphere can be adjusted, supplying a compound in a liquid, gaseous or solid form which decomposes on heating to produce carbon, such as benzene, toluene, pyridine, butane gas, melamine or the like, and heat-treating the compound at higher than the decomposition temperature of the compound, e.g. 350 to 1,000° C.

The amount of the carbon to be coated on the surface of core material is 10 to 200 parts by weight per 100 parts by weight of the core material.

Such method and similar methods are described in detail in JP-B-7-111026, JP-B-7-111027, JP-B-7-111028, etc.

A coating method using tin oxide comprises, for example, the steps of dispersing the core material in water to give a slurry, adding dropwise to the slurry a hydrochloric acid solution of tin chloride, optionally a hydrochloric acid solution of a metal compound capable of forming a metallic oxide to be coated concurrently with tin oxide, for example, a hydrochloric acid solution of antimony chloride and an aqueous solution of sodium, hydroxide, removing the insolubles and heat-treating the residue. Examples of the metallic oxide to be coated concurrently with tin oxide include oxides of indium, bismuth, cobalt, molybdenum or the like as well as the antimony described above. These oxides may account for about 0.01 to about 75% by weight of the oxides to be coated. These metals other than tin may be doped to increase the electroconductivity and whiteness. The amount of tin oxide or the like to be coated on the core material is 50 to 300 parts by weight calculated as a metal oxide per 100 parts by weight of the core material.

Such method and similar methods are described in detail in JP-B-62-4328, JP-A-2-149424, JP-B-7-23221, etc.

The electroconductive resin composition of the invention can be prepared by adding the foregoing electroconductive fibers to a resin. There is no limitation on the kind of matrix resin for the electroconductive resin composition. One or more resins can be selected from various resins. Specific examples of such resins are polyethylene, polypropylene, polyvinyl chloride resins, polyamide, polyimide, polyamideimide, ABS resins, thermoplastic polyester, polycarbonate, polyacetal, polyphenylene sulfide, polyphenylene ether, polysulfone, polyether sulfone, polyether imide, polyether ether ketone, polyacrylontrile, rayon, polyurethane, epoxy resins, unsaturated polyester resins, vinyl ester resins, phenolic resins, alkyd resins, silicone resins and melamine resins.

For use as a raw material for the electroconductive thread, preferred resins suitable for spinning are, for example, polyester, polyamide, polyethylene, polypropylene, polyvinyl, polyether, polycarbonate and like thermoplastic resins, polyacrylonitrile, rayon, polyurethane and like resins which are soluble in solvents.

The electroconductive fibers can be added to the resin according to the present invention, for example, by kneading a melt using a twin-screw extruder. In this case, the electroconductive fibers may be surface-treated beforehand with an epoxysilane, aminosilane or like silane coupling agents to improve the dispersibility of the fibers in the resin. Resin pellets may be dry-blended beforehand with the electroconductive fibers by a Henschel mixer, supermixer or the like. When electroconductive fibers are added to a solvent-soluble resin or a thermosetting resin, the resin is provided in a liquid form or a liquefied form and, so that the fibers are dispersed in the liquid resin with a disperser, a ball mill or the like.

The amount of the electroconductive fibers to be added to the resin is suitably determinable depending on the kind of resin and desired degree of electroconduc-tivity but is usually 5 to 85% by weight, preferably 40 to 70% by weight, based on the composition. The obtained electroconductive resin composition is satisfactory both in moldability for spinning and in electroconductivity if it contains the electroconductive fibers in said amount range. The electroconductive resin composition for use herein has a volume resistivity of $10^{-3}$ to $10^{9}\Omega$. cm.

An electroconductive powder having an average particle size of less than 5 $\mu$m may be mixed with the electroconductive fibers within the range which does not impair the effects of the present invention. Preferred electroconductive powders are those prepared by mixing a suitable metal or metallic oxide as a secondary component with tin oxide, antimony oxide, silver oxide, copper oxide, cadmium oxide, lead oxide or the like. Examples of the secondary component are aluminum oxide for tin oxide, and antimony oxide, tin or antimony for tin oxide. The amount of the electroconductive powder to be used is 5 to 85% by weight, preferably 40 to 70% by weight based on the resin, calculated as the total amount of the electroconductive fibers and the powder, i.e. as the amount of the electroconductive filler and is 1 to 90% by weight based on the total electroconductive filler.

The resin composition of the present invention may contain, in addition to the resin and the electroconductive fibers, flame retardants, heat stabilizers, ultraviolet absorbers, dyes, pigments, viscosity modifiers and other additives within the range which does not impair the effects of the present invention.

The obtained resin composition may be stored or transported in the form of pellets and may be melt-spun in a molding process of the spinning operation.

Examples of the spinning method useful in this invention include a melt-spinning method, a wet spinning method and a dry spinning method, all using a conventional composite spinning device. In the melt-spinning method, a take-up rate may be as low as approximately 500 to 2000 m/min or as high as approximately 2000 to 4000 m/min or as superhigh as approximately 5000 m/min or more. Generally in low- or high-rate spinning, yarns are given high strength when stretched concurrently with or after spinning. However, stretching is scarcely required in superhigh-rate spinning.

The electroconductive resin composition of the present invention may be useful to obtain electroconductive fibers having a core-sheath structure. The electroconductive fibers of core-sheath structure consists of the electroconductive resin for use herein as the core component and a resin free of an electroconductive substance as the sheath component. Examples of the core-sheath composite structures include a concentrically core-sheath arrangement, an eccentrically core-sheath arrangement and a multicore-sheath arrangement. A suitable core-sheath arrangement can be selected depending on the purpose and the required properties. The method detailed in JP-A-9-157953 can be carried out.

BEST MODE OF CARRYING OUT THE INVENTION

The present invention will be described in more detail with reference to the following reference examples and examples.

REFERENCE EXAMPLE 1

Mixed together were 500 g of rutile titanium dioxide, 250 g of potassium carbonate, 100 g of potassium chloride and 250 mg of magnesium oxide. Then the mixture was molded into a tubular shape under a molding pressure of 100 kgf/cm$^2$. The molded product was placed into a furnace and was heated from 50° C. to 950° C. over a period of 3 hours. Then the molded product was cooled to 600° C. over a period of 1 hour after it was maintained at said baking temperature for 1 hour. The fired product was taken out from the furnace and was cooled to room temperature. The fired product was immersed into warm water, unravelled, filtered and dried to give a fine fibrous product. The obtained product was observed under a scanning electron microscope and subjected to X-ray diffraction with the result that the product was found to be potassium tetratitanate fibers having an average fiber diameter of 0.13 μm and an average fiber length of 3 μm.

REFERENCE EXAMPLE 2

The fine potassium tetratitanate fibers prepared in Reference Example 1 were dispersed in water and were adjusted to a pH of 9 with sulfuric acid. The dispersion was filtered, and the fibers were dried and baked at 900° C. for 1 hour. The obtained product was observed under a scanning electron microscope and subjected to X-ray diffraction with the result that the product was found to be potassium hexatitanate fibers having an average fiber diameter of 0.13 μm and an average fiber length of 3 μm.

REFERENCE EXAMPLE 3

The fine potassium tetratitanate fibers prepared in Reference Example 1 were dispersed in a 1 N-sulfuric acid solution in an amount of 5 g per 100 ml of the solution. The potassium was extracted with stirring for about 3 hours. After the residue was washed with water, the washings were filtered and the fibers were dried and baked at 550° C. for 2 hours. The obtained product was observed under a scanning electron microscope and subjected to X-ray diffraction with the result that the product was found to be monoclinic titania fibers having an average fiber diameter of 0.13 μm and an average fiber length of 3 μm.

EXAMPLE 1

25 g of the potassium hexatitanate fibers prepared in Reference Example 2 were dispersed in 250 ml of water and were made into a slurry with stirring while the water was maintained at 70° C. Added dropwise to the slurry over a period of about 1 hour were 13 g of an aqueous solution of stannic chloride (23% by weight, calculated as Sn) and 1.28 g of antimony trichloride dissolved in 6.66 g of 12% by weight of hydrochloric acid, while 15% by weight of an aqueous solution of sodium hydroxide was separately added dropwise to retain the pH of the total reaction mixture in the range of 3 to 4. After completion of first stage dropwise reaction, stirring was continued for 30 minutes while maintaining the same pH and the same liquid temperature.

A mixture of 13 g of an aqueous solution of stannous chloride (23% by weight, calculated as Sn) and 10 g of 12% by weight of hydrochloric acid was added dropwise over a period of about 1 hour, while an aqueous solution of 15% by weight of sodium hydroxide was separately added dropwise as done in the first stage to retain the pH of the total reaction mixture in the range of 3 to 4. After completion of second stage dropwise reaction, stirring was continued for 30 minutes while maintaining the same pH and the same liquid temperature. Thereafter the reaction mixture was cooled to room temperature and filtered, and the fibers were washed with water, dehydrated and dried. The obtained dry product was heat-treated at 450° C. for 1 hour in the atmosphere, giving white electroconductive fibers having an average fiber diameter of 0.13 μm and an average fiber length of 3 μm. Chemical analysis shows that the product comprised potassium hexatitanate fibers coated with an electroconductive layer in a total amount of about 75 parts by weight per 100 parts by weight of the core material, the electroconductive layer consisting of a first coating layer composed of stannic oxide and antimony oxide and a second coating layer composed of stannous oxide. The obtained electroconductive fibers are hereinafter referred to as "electroconductive fiber A".

EXAMPLE 2

The same procedure as in Example 1 was repeated using the monoclinic titania fibers prepared in Reference Example 3 as the core material, thereby giving white electroconductive fibers having an average fiber diameter of 0.13 μm and an average fiber length of 3 μm. Chemical analysis shows that the product comprised fibers coated with an electroconductive layer in a total amount of about 76 parts by weight per 100 parts by weight of the core material, the electroconductive layer consisting of a first coating layer composed of stannic oxide and antimony oxide and a second coating layer composed of stannous oxide. The obtained electroconductive fibers are hereinafter referred to as "electroconductive fiber B".

EXAMPLES 3 and 4

A 6-nylon resin (a product of Toray Industries, Inc., available under a brand name Amilan CM1021TM) and the electroconductive fibers A obtained in Example 1 were kneaded in the proportions shown in Table 1 using a twin-screw extruder to give the electroconductive resin composition of the present invention. The volume resistivity (JIS K 6911) and the L value (whiteness, JIS Z-8722 to 8730) of the obtained electroconductive resin composition are shown in Table 1.

EXAMPLE 5

There was prepared a dimethylformamide solution of acrylonitrile resin comprising 93.5% by weight of acrylonitrile, 6.0% by weight of methyl acrylate and 0.5% by weight of sodium methacrylsulfonate. The electroconductive fibers A prepared in Example 1 were dispersed in the solution by a disperser, the amount of fibers being 45% by weight based on the total solid in the solution. The solvent was removed to give a solid. The solid had the volume resistivity and the L value shown in Table 1.

EXAMPLES 6 and 7

A 6-nylon resin (a product of Toray Industries, Inc., available under a brand name Amilan CM1021TM) and the electroconductive fibers B obtained in Example 2 were kneaded in the proportions shown in Table 1 using a twin-screw extruder to give the electroconductive resin composition of he present invention. The volume resistivity and the L value of the obtained electroconductive resin composition are shown in Table 1.

COMPARATIVE EXAMPLE 1

A 6-nylon resin ("Amilan CM1021TM") and electroconductive particles (brand name "W-1", titanium oxide particles coated with stannic oxide, average particle size of 0.2 μm, a product of Mitsubishi Material Corp.) were kneaded using a twin-screw extruder to give a resin composition. The volume resistivity and the L value of the obtained resin composition are shown in Table 1.

COMPARATIVE EXAMPLE 2

A 6-nylon resin (brand name "Amilan CM1021TM", a product of Toray Industries, Inc.) and electroconductive potassium titanate fibers (brand name "Dentol WK200B", potassium titanate fibers coated with tin oxide, average fiber length of 13 μm, and average fiber diameter of 0.5 μm, a product of Otsuka Chemical Co., Ltd.) were kneaded using a twin-screw extruder to give a resin composition. The volume resistivity and the L value of the obtained resin composition are shown in Table 1.

COMPARATIVE EXAMPLE 3

A 6-nylon resin ("Amilan CM1021TM", a product of Toray Industries, Inc.) and electroconductive titania fibers (brand name "Dentol WK 500", titania fibers coated with tin oxide, average fiber length of 7 μm, and average fiber diameter of 0.2 μm, a product of Otsuka Chemical Co., Ltd.) were kneaded using a twin-screw extruder to give a resin composition. The volume resistivity and the L value of the obtained resin composition are shown in Table 1.

The electroconductive resin compositions prepared in Examples 3 and 6 and Comparative Examples 2 and 3 were spun and drawn out from two nozzles of a kneading-type spinning device and were taken up at a taking-up rate of 4000 m/min, whereby electroconductive yarns (25 denier/2 filaments) were produced. The spinning ability of the resin compositions and the increase of pressure are shown in Table 2.

The spinning ability was evaluated by observing the spinning process to assess the state of clogging or non-clogging in the filter and the nozzles and the stability in the diameter of the obtained yarns.

The increase of pressure was evaluated by measuring the pressure 1 hour after the start of spinning operation and observing the increase of pressure. The result was rated as proper when the spinning operation proceeded at a stable pressure without marked increase of pressure.

The assessment was expressed with a letter ○ when continuous spinning was feasible and with a letter X when it was infeasible.

When the electroconductive resin compositions prepared in Examples 3 and 6 were spun with a kneading-type spinning device, there occurred no clogging in the filter and the nozzles so that spinning was performed with stability. On the other hand, when the electroconductive resin compositions prepared in Comparative Examples 2 and 3 were spun with a kneading-type spinning device, the filter and the nozzles were clogged in the spinning operation because of large-size fillers contained in the electroconductive resin composition, resulting in failure to continue spinning operation due to gradual increase of back pressure, although the resin compositions had suitable whiteness.

TABLE 1

| | resin | filler | amount | volume resistivity | L value |
|---|---|---|---|---|---|
| Ex. 3 | 6-nylon | fiber A | 40 wt % | $5 \times 10^7$ | 80 |
| Ex. 4 | 6-nylon | fiber A | 65 wt % | $4 \times 10^4$ | 77 |
| Ex. 5 | acrylic resin | fiber A | 35 wt % | $2 \times 10^5$ | 81 |
| Ex. 6 | 6-nylon | fiber B | 40 wt % | $8 \times 10^7$ | 80 |
| Ex. 7 | 6-nylon | fiber B | 65 wt % | $7 \times 10^4$ | 73 |
| Com. Ex. 1 | 6-nylon | W-1 | 65 wt % | $3 \times 10^5$ | 48 |

TABLE 1-continued

| | resin | filler | amount | volume resistivity | L value |
|---|---|---|---|---|---|
| Com. Ex. 2 | 6-nylon | WK200B | 40 wt % | $2 \times 10^7$ | 60 |
| Com. Ex. 3 | 6-nylon | WK500 | 40 wt % | $9 \times 10^7$ | 78 |

TABLE 2

| | spinning ability | increase of pressure | evaluation |
|---|---|---|---|
| Ex. 3 | excellent without clogging | stable without marked pressure increase | ○ |
| Ex. 6 | excellent without clogging | stable without marked pressure increase | ○ ○ |
| Com. Ex. 2 | clogging in filter and nozzles | unstable with pressure increase | X |
| Com. Ex. 3 | clogging in filter and nozzles | unstable with pressure increase | X |

INDUSTRIAL APPLICABILITY

According to the present invention, there are provided fine electroconductive fibers, an electroconductive resin composition prepared from the fibers which composition can be suitably used as the raw material for an electroconductive thread having, e.g., high strength and excellent electroconductivity, and electroconductive threads produced from the resin composition.

What is claimed is:

1. An electoconductive thread prepared by spinning an electroconductive resin composition comprising 5 to 85% by weight of an electroconductive fiber, said fiber comprising a fibrous core material whose surface is coated with an electroconductive substance composed mainly of carbon or tin oxide, the fibrous core material having an average fiber length of 1 to 5 μm, an average fiber diameter of 0.01 to 0.5 μm and an aspect ratio of 3 or more.

2. An electoconductive thread prepared by spinning an electroconductive resin composition comprising 5 to 85% by weight of an electroconductive fiber, said fiber comprising a fibrous core material whose surface is coated with an electroconductive substance composed mainly of carbon or tin oxide, the fibrous core material having an average fiber length of 1 to 4 μm, an average fiber diameter of 0.01 to 0.2 μm and an aspect ratio of 3 or more.

3. An electoconductive thread prepared by spinning an electroconductive resin composition comprising 5 to 85% by weight of an electroconductive fiber, said fiber comprising a fibrous core material whose surface is coated with an electroconductive substance composed mainly of carbon or tin oxide, the fibrous core material being a compound represented by the formula $mK_2O.nTiO_{2-x}.yH_2O$, wherein m is 0 or 1, n is 1 or a number of 4 to 8, x is a number in the range of $O \leqq x < 2$, y is a number of 0 to 10, provided that when m is 0, n is 1, whereas when m is 1, n is a number of 4 to 8, and the fibrous core material having an average fiber length of 1 to 5 μm, an average fiber diameter of 0.01 to 0.5 μm and an aspect ratio of 3 or more.

* * * * *